United States Patent [19]

Wilmes

[11] 4,237,664

[45] Dec. 9, 1980

[54] SLIDING DOOR UNIT

[75] Inventor: Richard J. Wilmes, Stillwater, Minn.

[73] Assignee: Andersen Corporation, Bayport, Minn.

[21] Appl. No.: 927,454

[22] Filed: Jul. 24, 1978

[51] Int. Cl.[3] ..... E06B 7/14

[52] U.S. Cl. ..... 52/209; 49/471

[58] Field of Search ..... 52/207, 209, 60, 97; 49/471, 468, 467

[56] References Cited

U.S. PATENT DOCUMENTS

| | | | |
|---|---|---|---|
| 2,129,381 | 9/1938 | Oftedal et al. | 49/471 |
| 2,273,877 | 2/1942 | Kammeres | 49/467 X |
| 3,114,943 | 12/1963 | Casebolt | 49/468 |
| 3,396,491 | 8/1968 | Giesbrecht | 52/207 X |
| 3,410,027 | 11/1968 | Bates | 49/471 |
| 3,990,187 | 11/1976 | Brown et al. | 49/467 |

FOREIGN PATENT DOCUMENTS

| | | | |
|---|---|---|---|
| 1220397 | 1/1971 | United Kingdom | 49/471 |

OTHER PUBLICATIONS

Anderson Window Walls, Catalog No. 782, pp. 41, 42.

*Primary Examiner*—Carl D. Friedman

*Attorney, Agent, or Firm*—Merchant, Gould, Smith, Edell, Welter & Schmidt

[57] ABSTRACT

A sliding door unit having a stationary and a movable door panel has an improved sill which underlies and supports the door panels. The sill includes sill surfaces of different elevations for imposing a gravitational potential on any water seeking to infiltrate between the door panels. In addition, the sill includes a drain tank which operatively communicates with the highest sill surface for draining any water reaching that sill surface to an exterior side of the sill. The sill also includes an improved support member for supporting an outwardly extending threshold of the sill. Furthermore, the sill includes a guide system for guiding the stationary door panel into place during manufacture of the door unit.

9 Claims, 4 Drawing Figures

SLIDING DOOR UNIT

BACKGROUND OF THE INVENTION

1. Field of the Invention

This invention relates in general to sliding door units. More particularly, this invention relates to an improved sill for such a door unit which serves to support the stationary and movable door panels of the door unit.

2. Description of the Prior Art

Sliding door units are well known. One particular type of sliding door unit is that which is known as the Andersen Perma-Shield ® Gliding Door. The Perma-Shield ® Gliding Door unit is a door unit for use generally adjacent a patio of a house or other structure. This door unit includes a door frame or casing and two door panels. The door panels contain a glazing which comprises a double paned safety insulating glass. One of the door panels is fixed inside the frame. The other door panel slides relatively thereto to open and close the door opening in the door unit. When the door panels are in their closed position (i.e., the door opening is closed), the innermost frame members of each door panel, which are called the meeting stiles, are located generally adjacent one another and are spaced apart by a small gap.

Prior art sliding door units have had sills formed with various configurations. One particular type of sill has comprised an aluminum sill member having downwardly extending mounting projections. These projections were received in saw slots in a wooden framing member on which the sill was mounted. Furthermore, the prior art sill was divided into two parts: (1) a first inner portion which would underlie the movable door panel and have formed thereon the means for guiding the movable door panel during its sliding movement, and (2) a second outer portion positioned to the exterior of the inner portion and forming a threshold on which the person going through the doorway opening from the outside would step. These inner and outer sill portions were separated by a vinyl barrier.

One problem with the prior art sill construction noted above is that as people stepped on the threshold of the sill it would often tend to fracture the sill or separate the outer sill portion from the vinyl barrier. When the sill became cracked, this would require replacement which is an expensive and inconvenient procedure. In addition, if the sill became cracked and detached from its framing members, this would allow water to infiltrate into the interior of the structure in which the door unit was mounted. More particularly, one common problem in such units was that water often infiltrated in the gap between the stationary and movable door panels. This problem could be particularly acute in a heavy or driving rain storm because the construction of the prior art sills was not specifically designed to alleviate this problem of water infiltration.

Prior art sliding door units made some provision for supporting that portion of the sill which formed the outer or exterior threshold. Conventionally, the support was accomplished merely by securing a two-by-four to the front face of the framing member on top of which the sill was mounted. This two-by-four would be positioned to abut up against the bottom of the outer threshold. As people entering the building stepped on the threshold, the threshold and their weight would be supported by this two-by-four piece of lumber. Although such a sill support is generally effective for supporting the threshold, certain disadvantages are presented by the use of a piece of lumber for the sill support. One primary disadvantage is that the size of the lumber must usually be cut to different widths if the openings in which the sill was mounted had different thicknesses. Thus, when the framing members defined an opening having a relatively large thickness, a two-by-four positioned beneath the threshold might extend out past the edge of the threshold. This would require that the two-by-four be cut until it was flush with the threshold edge. The fact that no single sill support could accommodate various sized thicknesses in the opening for the door unit is a disadvantage as time and labor must be expended in cutting the prior art sill supports to size.

In the manufacture of sliding door units it is often difficult to adequately guide and secure the stationary door panel in the door frame. This problem is accentuated because the door panels are large, bulky and also quite heavy which makes them extremely hard to handle. To the best of applicant's knowledge, there has been no completely satisfactory method for guiding the permanent door panel into its proper assembled position during the manufacture thereof. The lack of such a system has made the task of manufacturing such door units more difficult. This increases the expense of manufacturing the unit and the expense to the purchaser in buying the unit.

SUMMARY OF THE INVENTION

One aspect of this invention is the provision of a sliding door unit having an improved sill construction which alleviates some of the above-noted problems in the prior art.

The present invention includes an improved sliding door unit of the type having a first stationary door panel and a laterally offset second movable door panel supported in the door frame. The door frame includes a sill beneath the door panel. The sill includes a first sill surface located generally adjacent the innermost door panel and a second sill surface located generally adjacent the exterior door panel. The second sill surface is located above the first sill surface and behind the exterior door panel to minimize water infiltration between the door panels. In other words, the present invention relates to an improved sill having means for imposing a gravitational potential on any water on the first sill surface which seeks to infiltrate between the meeting stiles of the first and second door panels.

The present invention also incorporates in a sliding door unit or other suitable door unit an improved sill support. The sill support is attached between an outer threshold portion of the sill and a framing member on which the sill is mounted. The improved sill support of this invention is one in which a pivotal connection is formed by a ball and socket joint between one end of the sill support and the threshold. This pivotal connection allows a single standard width sill support to be used regardless of the lateral thickness of the framing member on which the sill is mounted.

Finally, the present invention relates to a sliding door unit having means for guiding the stationary door panel into place during manufacture thereof. This guiding means includes a sill configuration having an upwardly extending vertical guide wall and at least one guide block located in front of the guide wall. The guide block engages a groove in the bottom edge of the stationary panel. The stationary panel may be located in place by abutting the rear of the stationary panel against the guide wall, by engaging the guide block in the groove, and by transversely sliding the stationary door panel to its assembled position.

BRIEF DESCRIPTION OF THE DRAWINGS

This invention will be described hereafter in the Detailed Description, when taken in conjunction with the following drawings, in which like reference numerals denote like elements throughout.

DETAILED DESCRIPTION

The present invention relates to an improved sill member which is part of a door frame for a sliding door unit. One particular type of sliding door unit with which the present invention can be used will be illustrated herein as door unit 2. Door unit 2 is preferably of the type which is known as the Perma-Shield ® Gliding Door II, manufactured by the Andersen Corporation of Bayport, Minn., which is the assignee of the present application. However, the sill according to this invention can be used with other sliding door units.

Figure 4:
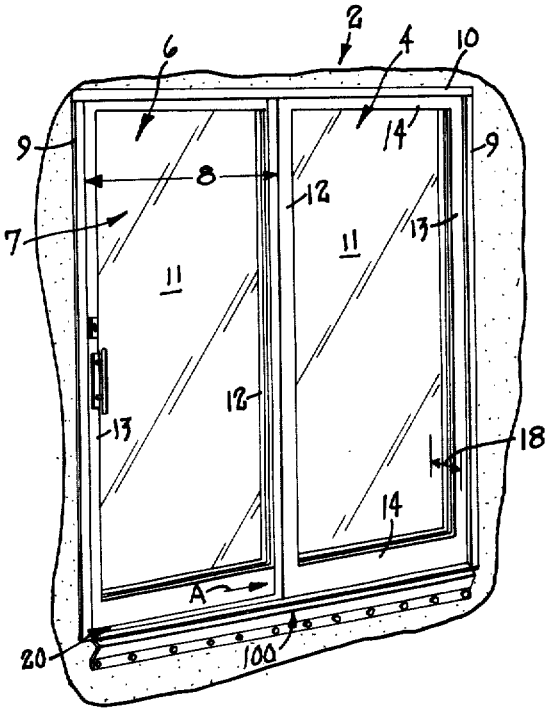
FIG. 4 is a perspective view of an improved door unit having the improved sill according to the present invention.

Referring first to FIG. 4, door unit 2 comprises a stationary or fixed door panel 4 and a movable door panel 6 supported in a door frame. The improved sill of the present invention is generally indicated as 20. Door panels 4 and 6 are substantially identical except for the fact that door panel 4 is stationary on the sill 20 while the door panel 6 is slidably movable thereon. Movement of the door panel 6 can open and close a door opening 7 in the door unit 2. The door opening 7 comprises that space 8 between the innermost edge of the stationary door panel 4 and the opposed side of the door frame. The door frame is substantially rectangular having two upwardly extending side frame members 9 and a top frame member 10. The sill 20 comprises the bottom frame member of the door frame. Preferably, the door frame members are all assembled such that the door panels 4 and 6 can be mounted therein. Door units 2 are then installed in any suitable rough opening provided in whatever structure in which the door unit is intended to be mounted.

Door panels 4 and 6 usually comprise a rectangular frame in which a glazing member is fixedly supported. As shown herein glazing member 11 comprises double-paned safety insulating glass. The frame of the door panels 4 and 6 each comprise two vertically extending members 12 and 13 customarily referred to as stiles. These stiles are connected at their top and bottom ends by horizontally extending rails 14. When the door panels 4 and 6 are in a closed position such that the movable panel 6 allows no access through the door opening 7, two of the vertically extending stiles of the door panels 4 and 6 will be aligned with one another in a generally parallel and spaced relationship. These stiles are illustrated as 12 in FIG. 4 and are usually called the meeting stiles. The gap occurring between the meeting stiles 12 is usually sealed by a weatherstrip material which extends over most of the length of the stiles. However, there has conventionally been a problem of water or other substances being able to infiltrate at the lower edge of the meeting stiles in the gap therebetween as generally shown by the arrow "A" in FIG. 4. This water infiltration illustrated by the arrow "A" occurs between the exterior of the door panels and the interior of the door panels regardless of which one is the movable panel.

Figures 1, 3:
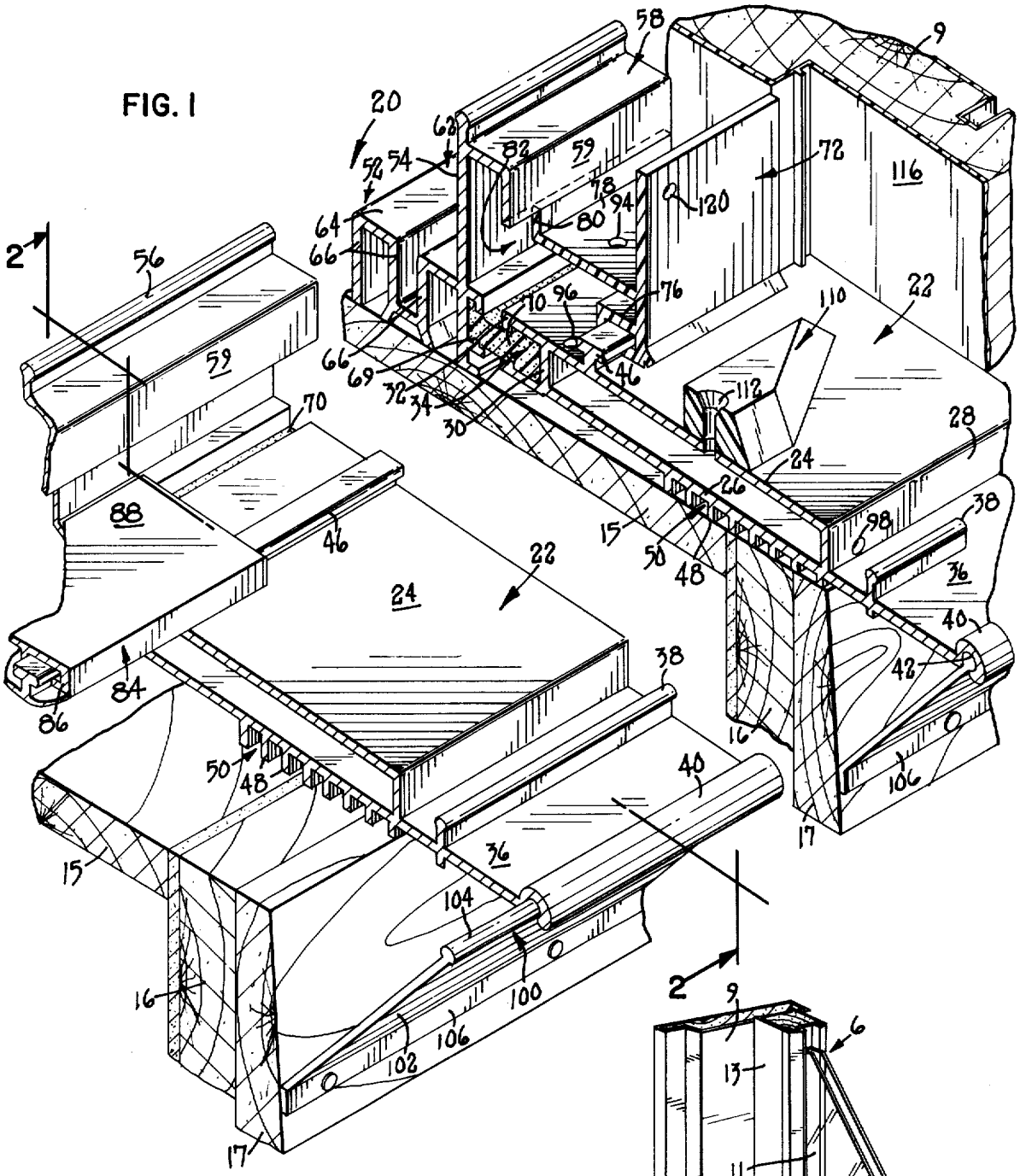
FIG. 1 is a partial perspective view of an improved sill according to this invention, particularly illustrating the two portions of the sill which respectively underlie the movable and stationary door panels.
FIG. 3 is a perspective view, partially broken away, of the improved sill according to this invention and a portion of the movable door panel, illustrating particularly the construction of the sill adjacent the movable door panel in its closed position.
Figure 2:
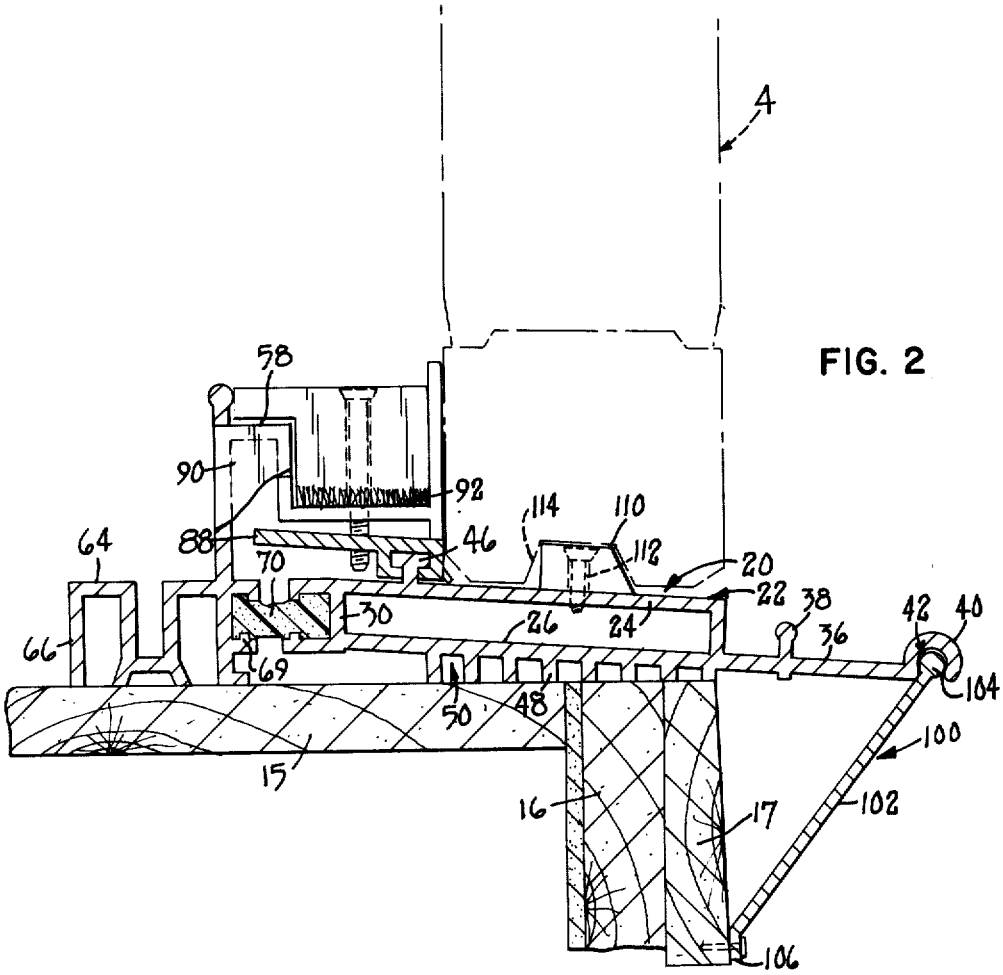
FIG. 2 is a cross-sectional view along lines 2—2 of FIG. 1.

Referring now to FIGS. 1 and 2, door unit 2 including the sill 20 is conventionally mounted in a rough rectangular opening provided in the building in which the door unit is to be installed. This opening is usually defined by wooden framing members which form the outer edges of the opening. Sill 20 is designed to be fixedly attached to the bottom framing member or a subfloor generally indicated as 15 in FIG. 2. The bottom framing member 15 may be faced by vertically extending front framing members 16 and 17. In any event, the rough opening in which the sill 20 is mounted has an overall width or thickness generally indicated as 18 in FIG. 4. The width 18 can vary depending on the size of the framing members used in constructing the rough opening.

Sill 20 comprises a first outer portion which includes a base member or surface generally indicated as 22. The base member 22 extends substantially the entire width of both the movable and stationary door panels 4 and 6 between the opposed side members 9 of the door frame. As shown in FIGS. 1 and 2, the base member 22 is not formed from a single planar sheet of material. Rather, the base member 22 in effect is formed with a double walled construction having an upper wall 24 and a lower wall 26. Upper wall 24 defines a first sill surface. The walls 24 and 26 are joined together at their front edge by a vertical wall 28 and at their rear edge by a second vertical wall 30. Two L-shaped flanges 32 extend rearwardly from the vertical wall 30 to define a U-shaped chamber 34.

A substantially planar outer threshold member 36 extends from the forward edge of the base surface 22 and is coplanar with lower wall 26. The outer threshold 36 has an upwardly extending rail 38 running the length thereof. Rail 38 can slidably support a screen door (not shown) thereon. The forward edge of the threshold portion 36 is formed with an arcuate lip or bead 40 having a downwardly extending opening 42. Bead 40 forms part of a pivotal connection for a sill support member as described hereafter.

In addition, the base member 22 has an upwardly extending T-shaped rail 46 thereon. Rail 46 is positioned slightly in front of the location of wall 30 and extends upwardly from the upper wall 24. Rail 46 extends substantially the entire length of the base member 22. Base member 22 may be suitably secured to the horizontal framing member 15 in any appropriate manner, e.g. by screws or bolts. As shown in FIGS. 1 and 2, the lower wall 26 of the base member 22 has a plurality of spaced downwardly extending flanges 48 defining a plurality of grooves 50. Grooves 50 run the entire length of the base member 22. A suitable caulking compound may be injected into the grooves 50 seal the base member 22 to the horizontal framing member 15. This prevents water seepage from occuring beneath the sill 20.

In addition, sill 20 includes a second inner portion generally illustrated herein as 52. Second portion 52 includes an upwardly extending vertical wall 54. Wall 54 has a rounded bead 56 at the top thereof. Bead 56 serves to mount the movable door panel 6 for sliding movement as shown generally in FIG. 3. The wall 54 has an L-shaped flange 58 extending from the forward side thereof near the top. Referring to FIG. 3, a flexible sealing strip 60 which depends from the bottom edge of the door panel 6 bears against the vertical wall 59 of flange 58 as the door panel is slid on rail 56. In addition, flange 58 helps form part of an enclosed drain tank system in a manner to be disclosed hereafter.

The second sill portion 52 further includes a support structure generally indicated as 62 which extends from the rear side of the vertical wall 54. The support structure 62 has a generally horizontal top surface 64 and various downwardly depending vertical walls 66 which engage the horizontal framing member 15. The support structure 62 has the horizontal top surface 64 thereof suited for receiving an inner wooden threshold member generally indicated as 68. Threshold 68 in effect is floating relative to the wall 54. In other words, the threshold 68 can effectively be positioned at any vertical position along the wall 54 as necessary to match the inner threshold 68 to the level of the interior floor in the building. All that would be required would be to insert a suitable shim beneath the inner threshold 68 and the horizontal top surface 64. In addition, the second sill portion has two forwardly projecting L-shaped flanges 69 generally opposed to the flanges 32 on base member 22.

Both the base member 22 which forms an outer portion of the sill 20 and the second portion 52 which forms the inner part of the sill 20 are suitably made to extend longitudinally the entire width of the door unit 2. The base surface 22 is positioned adjacent the exterior of the door unit (i.e. that side of the door unit closest to the outside of the building), and the second sill portion 52 is positioned adjacent the interior of the door unit (i.e. that side of the door unit which is adjacent the interior of the building). Both the base surface 22 and the second portion 52 are preferably made of anodized aluminum which is case, extruded, or otherwise formed into the shapes shown. Furthermore, the base member 22 is laterally separated by a short distance from the second portion 52 of the sill. This distance is suitably sealed by a thermal barrier material generally indicated as 70 received between the flanges 32 on the base member 22 and the flanges 69 on the second portion 52. The thermal barrier material 70 comprises any suitable material which will prevent conductive heat loss between the outer base member 22 and the rear portion 52. Thus, heat will not be conducted through the sill 20 during the winter to the exterior of the building as the thermal barrier material 70 prevents this conduction.

The improved sill 20 according to the present invention is formed to provide means for solving the problem of water infiltration between the meeting stiles 12 of the door panels 4 and 6. As shown in FIG. 4, during a rain or snow storm water will impinge on that portion of the sill 20 on the exterior of the building and will collect on the first sill surface defined by wall 24. In many cases, the water will be driven or forced in the direction of the arrow "A" between the movable and stationary door panels. This water will then be able to come into the interior of the building. This is undesirable as such water can in extreme instances damage the interior of the building or damage parts of the door unit 2 itself.

The means adopted for solving the problem of water infiltration is broken into two separate components each of which function separately and collectively to deal with the problem. These components include means for minimizing water infiltration in the first place between the meeting stiles of the door panels, and secondly means for draining away any water which does infiltrate between the meeting stiles to the exterior of the sill. Both of these components could be used separately in an attempt to deal with the problem of water infiltration. However, they are most effective when used in combination together.

The means for solving the problem of water infiltration can best be understood with reference to FIGS. 1 and 2. The first sill surface defined by the upper wall 24 is that surface on which water often collects during a storm or the like. It is this water which must be prevented from infiltrating between the stiles 12. Referring to FIG. 1, a substantially rigid insert is releasably coupled to the T-shaped rail 46 over approximately half of the first sill surface 24. The insert is indicated generally as 72 and includes an upwardly extending guide wall 74. Guide wall 74 has a mounting clip 76 with a configuration shaped to match that of the T-shaped rail 46. By virtue of the clip 76, the insert 72 can be mounted on the base member 22 by simply sliding the insert onto the rail member 46 before the sill 20 is connected to all the other parts of the door frame. Preferably, insert 72 is made of a vinyl or other plastic material.

In addition, the insert 72 includes a substantially horizontal wall 78 which extends rearwardly from the guide wall 74. Wall 78 has an upwardly extending vertical wall 80 at its rear edge thereof. As shown in FIG. 1, when the insert 72 is coupled to the rail member 46, wall 78 extends rearwardly toward the vertical wall 54. The vertical wall 80 will be aligned with the vertical wall 59 of the L-shaped flange 58 and be spaced closely beneath wall 59 to coact therewith. Together, the insert 72 cooperates with the second portion 52 of the sill to define a substantially enclosed space or chamber generally indicated as 82. Space 82 forms part of a drain tank system as recited hereafter. The horizontal wall 78 of the insert 72 forms a second sill surface. This second sill surface has an elevation considerably higher than the elevation of the first sill surface defined by the upper wall 24. When coupled to the rail 46, the insert 72 is located in back of and adjacent to the stationary door panel 4 as shown in FIG. 2.

A baffle 84 is releasably coupled to the rail 46 over the other half of the sill surface 24 not occupied by the insert 72. The baffle 84 has a mounting clip 86 for releasably coupling to the rail 46. Baffle 84 also includes a planar slanted surface 88 which extends rearwardly from the rail 46 towards the rear wall 54. The baffle 84 is located side-by-side with the insert 72. While the insert 72 is located in back of and adjacent to the stationary door panel 4, the baffle 84 is located in front of and generally adjacent to the movable door panel 6 at least when the movable door panel is in its closed position. Together, the baffle 88 and the insert 72 extend side by side the entire length of the improved sill 20. At the middle of the sill 20 where the insert 72 and the baffle 88 meet, the innermost end of the insert 72 has the chamber 82 thereof closed by a suitable end cap or plug 90. In addition, the horizontal surface 78 has an upwardly extending felt or fabric sealing strip 92 positioned immediately adjacent the end thereof adjacent baffle 84. The strip 92 engages the sealing strip 60 to seal the edge of the movable door panel 6 as it slides relatively thereto.

Together, the insert 72 and the baffle 84 form a system or means for minimizing the water infiltration between the meeting stiles 12. It can be appreciated that any water which is present on the sill surface 24 has to rise to the level of the second sill surface 78 in order for it to infiltrate between the meeting stiles. Thus, the difference in elevation between the first sill surface 24 and the second sill surface 78 is an important feature of the invention since it forms a means for imposing a gravitational potential on any water on the sill surface 24 seeking to infiltrate between the door panels. This gravitational potential must be overcome in order for the infiltration to occur. In other words, any water on the sill surface 24 has to rise or be forced up, either by capillary action or by some other external force, to the level of the second sill surface 78 before infiltration between the door panels can occur.

Baffle 84 also forms part of the means for minimizing the water infiltration. Such a baffle 84 serves as a means for deflecting any water impinging on the base member 22 in front of the movable door panel 6 away from the meeting stiles 12. The forwardly slanted surface 88 of the baffle 84 breaks up the wind pressure which drives water against the planar wall 54 and can induce an outwardly swirling action in the water being driven against the base member 22. This swirling action is represented by the arrow "B" in FIG. 3. Since this swirling action tends to resist the movement of water against the base member 22 and directs that water outwardly on the sill 20, the baffle 84 also minimizes water infiltration between the meeting stiles 12 by decreasing the amount of water which collects on sill surface 24.

However, assuming that some water does infiltrate between the meeting stiles 12, that water is promptly drained away to the exterior of the sill by means of an enclosed drain tank system formed in the sill 20. For example, the second sill surface has a first drain hole 94 positioned at one end thereof. Second sill surface 78 can be slightly slanted towards that drain hole 94 so that any water reaching the second sill surface will drain to the drain hole. Water passes through the drain hole 94 down into the enclosed chamber 82 and on top of the wall 24 and flange 32. A second drain hole 96 is positioned in the upper wall 24 of the planar base member 22 in front of vertical wall 30. Drain hole 96 further serves to drain the water down into the space occuring between the walls 24 and 26. Since walls 24 and 26 (and the flange 32) are forwardly slanted relative to the horizontal framing member 15, the water reaching this space will drain forwardly until it hits the front wall 28. A third drain hole 98 located in the front wall 28 will then drain the water to the exterior side of sill 20.

Thus, improved sill 20 of the present invention is advantageous in preventing water infiltration between the meeting stiles. It does so because of the change in elevation between the first and second sill surfaces 24 and 78 which discourages water from infiltrating. It does so also because of the baffle 84 which induces water impinging on the planar base member 22 in front of the movable panel 6 to be deflected outwardly. Further, it accomplishes its goal of preventing water infiltration through the enclosed drain tank system noted above. In all respects, the improved sill 20 of the present invention substantially solves the problem of water infiltration between the meeting stiles 12 of the door panels 4 and 6.

While the stationary door panel 4 has been illustrated as being exterior of the movable panel 6, the positions of these panels could be reversed. In such a case, the movable door panel would be positioned to the exterior of the stationary door panel. The present invention can be adapted to such configuration with the exception that the baffle 84 would probably not be used. In such a case, the insert 72 could still be located on the base member 22, but would be adjacent to and in back of the movable door panel in the normally closed position of the door panel. The baffle 84 would probably be eliminated since it would otherwise interfere with the sliding movement of the now exteriorly mounted movable panel. The drain tank system described above would also be incorporated into the sill 20 used when the movable panel is the exterior panel.

Another feature of the present invention is that which generally relates to an improved sill support 100. Sill support 100 is formed from a planar elongated support member 102 having a circular bead 104 at one end and a mounting flange 106 at the other end. The bead 104 is suited for being engaged in the opening 42 at the front of the outer threshold 36. Together the bead 104 and the opening 42 comprise a ball and socket joint by which the sill support member 100 is pivotably mounted relative to the framing members 15–17 and threshold 36. The mounting flange 106 is bendable relative to the planar support member 102. The improved sill support 100 is elongated and extends as shown in FIG. 4 the entire width of the door unit 2. Preferably, the improved sill support 100 is made of a ductile metal such as aluminum.

The pivotal connection occuring between the outer end of the sill support 100 and the outer end of the threshold 36 is important. Obviously, the overall width 18 of the framing members on which the sill 20 is mounted can vary. Thus, the distance between the face of the front framing member 17 and the outer edge of the threshold 36 can also vary depending on where the sill 20 happens to be mounted relative to the face of the front framing member 17. However, the pivotal connection between the sill support and the threshold 36 allows the same sill support 100 to be used in supporting the threshold regardless of the thickness 18 of the framing members or the distance between the front framing member 17 and the edge of the threshold. This is so because the sill support 100 can pivot as necessary to adjust to the actual location of the front framing member 17. For example, the farther the front framing member 17 moves away from the edge of the threshold 36, the closer the planar support member 102 will approach the threshold 36 itself and the farther up the face of the framing member 17 will the flange 106 be located.

Flange 106 can be bent to be made parallel to the framing member 17 regardless of the orientation of the planar support member 102 relative thereto. Sill support 102 can be attached to the framing member 17 by suitable nails or other securing members driven through the flange 106 and into engagement with the framing member 17. See FIG. 4. In addition, sill support 100 serves to support the threshold 36. Thus, if a person should step onto the threshold 36, his weight is at least partially supported by the sill support 100.

Finally, the improved door unit 2 according to the present invention incorporates a system or means for helping position and secure the stationary door panel 4 during manufacture of the door unit 2. This locating means includes the upwardly facing guide wall 74 of the insert 72. It also includes two guide blocks generally indicated as 110 which are fixedly located on the upper wall 24 in front of the guide wall 74. Blocks 110 may be secured by screws or the like which extend in bores 112 in the blocks. Only a portion of one guide block 110 is shown in FIG. 1, but both guide blocks will be positioned in front of the the wall 74 and will be an equal distance in front of the wall. Guide blocks 110 are shaped to be received in a U-shaped groove or slot 114 which extends the entire length of the bottom edge of the stationary door panel 4. See FIG. 2. In addition, the side member 9 of the door frame which is adjacent to the stile 13 of the stationary door panel 4 has a vertically extending slot or groove 116 therein. Slot 116 is slightly wider than the width of the stile 13.

In considering the manufacture of door unit 2, the door frame 4 is usually first assembled such that the side frame members 9 are fixedly joined to the top frame member 10 and the bottom sill 20. The door panels 4 and 6 are also completely assembled such that each is ready to be set into the door frame. In this regard, once the insert 72 is coupled to the rail 46 during the manufacture of the door unit, the guide wall 74 will be located adjacent the position that the bottom rail of the door panel 4 will have when assembled. Thus, to install the stationary door panel 4 in the door frame, it is only necessary to position the door frame 4 adjacent to the side of the insert and to align and engage the groove 114 with the guide blocks 110. Then, with the rear side of the lower rail of the door panel 4 firmly engaging against the guide wall 74 and with the blocks 110 engaging in the groove 114, the stationary door panel 4 can be easily slid to one side to its assembled position where it abuts against the entire length of the guide wall 72. In the assembled position of the door panel 4, the outermost stile 13 will also engage in the vertical slot 116 as the door panel reaches its assembled position. To secure the door panel in the door frame, it is only necessary for screws or bolts to be applied through holes 120 in guide wall 74. These screws or bolts when applied from the interior of the door unit and secured in the bottom rail of the door panel 4 will securely hold the door panel in place without any possibility of having that door panel jimmied or forced.

Various modifications to this invention will be apparent to those skilled in the art. The preceeding description has been to illustrate only a preferred mode of practicing this invention and not an exclusive mode. For example, the insert 72 although desirably releasably coupled to rail 46 could be integrally formed with the rail if so desired. Furthermore, although the improved sill support 100 and the stationary panel locating means of this invention are preferably used in conjunction with the sliding door unit 2, they could of course be used with other types of door units where appropriate. Thus, the scope of this invention is to be limited only by the appended claims.

I claim:

1. An improved sliding door unit (2) of the type having a first stationary door panel (4) and a second movable door panel (6) supported in a door frame which includes a sill (20) beneath the door panels, the movable door panel (6) being slidable relative to the stationary door panel (4) to a closed position to block a door opening (7) through the door frame, the stationary door panel (4) being located closer to an exterior side of the sill (20) than the movable door panel (6), wherein the improvement relates to an improved sill (20) which comprises:

(a) a first sill surface (24) located generally adjacent and in front of the movable door panel (6) when the movable door panel (6) is in its closed position;

(b) a second sill surface (78) located generally adjacent and in back of the stationary door panel (4), wherein the first and second sill surfaces (24 and 78) are located side-by-side along a line extending between the first and second door panels (4 and 6), and the second sill surface (78) being located above the first sill surface (24) and having a substantially solid vertical face (90) which extends down to the first sill surface (24) to block an opening between the door panels (4 and 6) to minimize water infiltration between the stationary and movable door panels (4 and 6); and (c) wherein the sill (20) further includes an enclosed drain tank which underlies and operatively communicates with the second sill surface (78), and wherein the drain tank is configured to drain any water reaching the second sill surface (78) to an exterior side of the sill.

2. An improved door unit (2) of the type having at least one door panel (4 or 6) mounted in a door frame which includes a sill (20) beneath the door panel, the sill (20) being mounted on a framing member (17) which is part of a structure in which the door unit (2) is installed, the sill (20) having a threshold (36) which extends forwardly of the framing member (17), and further including a sill support (100) underneath the threshold (36) and attached to the framing member (17) for supporting the weight exerted on the threshold (36), wherein the improvement relates to an improved sill support (100) having a pivotal connection with the threshold; wherein the sill support (100) comprises a planar support member (102) having the pivotal connection (104) at one end thereof and a mounting flange (106) at the other end thereof, the mounting flange (106) being suited for securing to the framing member (17) and being angularly adjustable relative to the planar support member (102) such that the mounting flange (106) can be parallel to the framing member (17) regardless of the angle of the support member (102) relative to the framing member (17).

3. An improved door unit as recited in claim 2, wherein the pivotal connection comprises a ball and socket joint.

4. An improved door unit as recited in claim 2, wherein the planar support member is longitudinally elongated to extend beneath the entire length of the threshold.

5. An improved sliding door unit (2) of the type having a stationary door panel (4) and a movable door panel (6) supported in a door frame which includes a sill (20) beneath the door panels, wherein the improvement relates to a sill (20) having means for guiding the stationary door panel (4) into place during manufacture of the door unit (2), wherein the sill (20) includes a base member (22) having an upwardly facing guide wall (74) adjacent an assembled position of the stationary door panel (4), and wherein the base member (22) includes at least one fixed guide block (110) located in front of the guide wall (74) and suited for engaging a groove (114) in the bottom of the stationary door panel (4), whereby the stationary door panel (4) is guided into its assembled position by abutting the bottom of the door panel (4)

against the base member (24), engaging the guide block (110) in the groove (114), and sliding the stationary door panel (4) transversely to its assembled position.

6. An improved sliding door unit as recited in claim 5, wherein a side member of the door frame has a vertical slot for receiving and aligning one side edge of the stationary door panel in its assembled position.

7. An improved sliding door unit (2) of the type having a first stationary door panel (4) and a second movable door panel (6) supported in a door frame which includes a sill (20) beneath the door panels, the movable door panel (6) being slidable relative to the stationary door panel (4) to a closed position to block a door opening (7) through the door frame, the stationary door panel (4) being located closer to an exterior side of the sill (20) than the movable door panel (6), wherein the improvement relates to an improved sill (20) which comprises:

(a) a first sill surface (24) located generally adjacent and in front of the movable door panel (6) when the movable door panel (6) is in its closed position;

(b) a second sill surface (78) located generally adjacent and in back of the stationary door panel (4), wherein the first and second sill surfaces (24 and 78) are located side-by-side along a line extending between the first and second door panels (4 and 6), and the second sill surface (78) being located above the first sill surface (24) and having a substantially solid vertical face (90) which extends down to the first sill surface (24) to block an opening between the door panels (4 and 6) to minimize water infiltration between the stationary and movable door panels (4 and 6);

(c) wherein the first sill surface (24) is defined by a base member (22) which extends substantially the entire width of both the stationary and movable door panels (4 and 6) in the closed positions thereof, and wherein the second sill surface (78) is defined by an insert (72) operatively coupled to the base member (22) adjacent only the stationary door panel (4); and (d) wherein the base member (22) has a substantially vertical wall (54) at a rear side thereof, and wherein the base member (22) includes a baffle (84) mounted thereon adjacent the movable door panel (6) in its closed position and located in front of the wall (54), the baffle (84) having an orientation relative to the wall (54) which causes water impinging thereon to be directed to an exterior side of the sill.

8. An improved sliding door unit as recited in claim 7, wherein the baffle and insert are mounted side-by-side on an elongated rail member on the base member.

9. An improved sliding door unit as recited in claim 7, wherein the insert is mounted in front of the wall and forms therewith an enclosed drain tank for draining any water on the second sill surface to an exterior side of the sill.

* * * * *